US009551229B2

(12) United States Patent
Rodriguez et al.

(10) Patent No.: US 9,551,229 B2
(45) Date of Patent: Jan. 24, 2017

(54) TURBINE AIRFOIL WITH AN INTERNAL COOLING SYSTEM HAVING TRIP STRIPS WITH REDUCED PRESSURE DROP

(71) Applicant: Siemens Aktiengesellschaft, München (DE)

(72) Inventors: Jose L. Rodriguez, Lake Mary, FL (US); Matthew J. Golsen, Deltona, FL (US)

(73) Assignee: Siemens Aktiengesellschaft, München (DE)

( * ) Notice: Subject to any disclaimer, the term of this patent is extended or adjusted under 35 U.S.C. 154(b) by 535 days.

(21) Appl. No.: 14/140,589

(22) Filed: Dec. 26, 2013

(65) Prior Publication Data

US 2015/0184524 A1 Jul. 2, 2015

(51) Int. Cl.
*F01D 5/18* (2006.01)
*F01D 9/02* (2006.01)

(52) U.S. Cl.
CPC ..... *F01D 5/188* (2013.01); *F01D 5/187* (2013.01); *F01D 9/02* (2013.01); *F05D 2240/127* (2013.01); *F05D 2250/711* (2013.01); *F05D 2250/712* (2013.01); *F05D 2260/2212* (2013.01); *F05D 2260/22141* (2013.01)

(58) Field of Classification Search
CPC ..... Y02T 50/676; F05D 2250/60; F05D 2250/611; F05D 2250/70; F05D 2250/711; F05D 2250/712; F05D 2260/221; F05D 2260/2212; F05D 2260/2214; F05D 2260/22141;F01D 5/18; F01D 5/187; F01D 25/12
See application file for complete search history.

(56) References Cited

U.S. PATENT DOCUMENTS

| | | | |
|---|---|---|---|
| 4,218,178 | A | 8/1980 | Irwin |
| 4,321,010 | A | 3/1982 | Wilkinson et al. |
| 4,604,031 | A | 8/1986 | Moss et al. |
| 5,217,348 | A | 6/1993 | Rup et al. |
| 5,281,084 | A | 1/1994 | Noe et al. |

(Continued)

FOREIGN PATENT DOCUMENTS

| | | |
|---|---|---|
| CA | 2480985 | 9/2009 |
| EP | 1760261 A1 | 3/2007 |

(Continued)

*Primary Examiner* — Eric Keasel
*Assistant Examiner* — Joshua R Beebe

(57) ABSTRACT

A turbine airfoil usable in a turbine engine and having at least one cooling system with an efficient trip strip is disclosed At least a portion of the cooling system may include one or more cooling channels having one or more trip strips protruding from an inner surface forming the cooling channel. The trip strip may have improved operating characteristics including enhanced heat transfer capabilities and a substantial reduction in pressure drop typically associated with conventional trip strips In at least one embodiment, the trip strip may have a cross-sectional area with a first section of an upstream surface of the trip strip being positioned nonparallel and nonorthogonal to a surface forming the cooling system channel extending upstream from the at least one trip strip and a concave shaped downstream surface of the at least one trip strip that enables separated flow to reattach to the cooling fluid flow.

9 Claims, 4 Drawing Sheets

(56) References Cited

U.S. PATENT DOCUMENTS

| | | | | |
|---|---|---|---|---|
| 5,465,780 | A | 11/1995 | Muntner et al. | |
| 6,241,468 | B1 | 6/2001 | Lock et al. | |
| 6,257,831 | B1 | 7/2001 | Papple et al. | |
| 7,080,971 | B2 | 7/2006 | Wilson et al. | |
| 7,163,373 | B2 * | 1/2007 | Liang | F01D 5/18 415/115 |
| 7,575,414 | B2 * | 8/2009 | Lee | F01D 5/186 415/115 |
| 8,029,234 | B2 | 10/2011 | Mccaffrey | |
| 8,292,578 | B2 | 10/2012 | Horiuchi et al. | |
| 8,511,977 | B2 * | 8/2013 | Hillier | F01D 5/18 415/178 |
| 2002/0005274 | A1 * | 1/2002 | Beeck | F01D 5/187 165/109.1 |
| 2003/0108422 | A1 * | 6/2003 | Merry | F01D 5/187 416/97 R |
| 2010/0115967 | A1 | 5/2010 | Maltson | |
| 2010/0143140 | A1 * | 6/2010 | Guemmer | F01D 5/143 416/193 A |
| 2010/0226761 | A1 | 9/2010 | Liang | |
| 2011/0033312 | A1 * | 2/2011 | Lee | F01D 5/187 416/97 R |
| 2011/0176930 | A1 | 7/2011 | Ahmad et al. | |

FOREIGN PATENT DOCUMENTS

| | | |
|---|---|---|
| GB | 1304678 | 1/1973 |
| JP | 10298779 | 10/1998 |
| JP | 2001073705 | 3/2001 |
| WO | 2013139938 A1 | 9/2013 |

* cited by examiner

TURBINE AIRFOIL WITH AN INTERNAL COOLING SYSTEM HAVING TRIP STRIPS WITH REDUCED PRESSURE DROP

FIELD OF THE INVENTION

This invention is directed generally to turbine airfoils, and more particularly to hollow turbine airfoils having cooling channels for passing fluids, such as air, to cool the airfoils

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures Typically, turbine blades are formed from an elongated portion forming a blade having one end configured to be coupled to a turbine blade carrier and an opposite end configured to form a blade tip. The blade is ordinarily composed of a leading edge, a trailing edge, a suction side, and a pressure side. The inner aspects of most turbine blades typically contain an intricate maze of cooling circuits forming a cooling system. The cooling circuits in the blades receive air from the compressor of the turbine engine and pass the air through the ends of the blade adapted to be coupled to the blade carrier. The cooling circuits often include multiple flow paths that are designed to maintain all aspects of the turbine blade at a relatively uniform temperature. At least some of the air passing through these cooling circuits is exhausted through orifices in the leading edge, trailing edge, suction side, and pressure side of the blade Cooling fluids pass over trip strips, which increase the heat transfer of the cooling system Most trip strips are formed from generally square or rectangular cross-sections, as shown in FIG. 1. Such configurations increase the cooling capacity of a cooling system but have inherent limitations, as shown by the loss regions 5 shown in FIG. 1. While advances have been made in the cooling systems in turbine blades, a need still exists for a turbine blade having increased cooling efficiency for dissipating heat and passing a sufficient amount of cooling air through the blade

SUMMARY OF THE INVENTION

A turbine airfoil usable in a turbine engine and having at least one cooling system with an efficient trip strip is disclosed. At least a portion of the cooling system may include one or more cooling channels having one or more trip strips protruding from an inner surface forming the cooling channel. The trip strip may have improved operating characteristics including enhanced heat transfer capabilities and a substantial reduction in pressure drop typically associated with conventional trip strips. In at least one embodiment, the trip strip may have a cross-sectional area with a first section of an upstream surface of the trip strip being positioned nonparallel and nonorthogonal to a surface forming the cooling system channel extending upstream from the at least one trip strip and a concave shaped downstream surface of the at least one trip strip that enables separated flow to reattach to the cooling fluid flow.

In at least one embodiment, a turbine airfoil may be formed from a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil. The cooling system may include one or more trip strips protruding from an inner surface defining a channel of the cooling system. The trip strip may be formed from a generally elongated body and the trip strip may have a cross-sectional area with at least a first section of an upstream surface of the trip strip being positioned nonparallel and nonorthogonal to a surface forming the cooling system channel extending upstream from the trip strip and a concave shaped downstream surface of the trip strip A downstream surface of the trip strip may be formed from a concave surface forming generally a quarter circle. An upstreammost point of the downstream surface of the trip strip may be positioned upstream from an intersection of the downstream surface at a top surface of the trip strip An upstreammost point of the downstream surface of the trip strip may be positioned upstream from an intersection of the downstream surface and the inner surface defining the channel of the cooling system. The trip strip include a nonlinear top surface. In at least one embodiment, the nonlinear top surface has a convex shaped outer surface The nonlinear top surface have a leading edge that is positioned closer to the inner surface defining the channel of the cooling system than a trailing edge of the nonlinear top surface The upstream surface of the trip strip may include a second section that is nonparallel and nonothogonal with the first section. The second section of the upstream surface may be positioned generally orthogonal to the surface forming the cooling system channel extending upstream from the trip strip. The second section of the upstream surface may be positioned generally orthogonal to a longitudinal axis of the channel of the cooling system in which the trip strip resides. The trip strip may have a consistent cross-sectional area throughout an entire length of the at least one trip strip During use, cooling fluid is passed into the cooling system, including the cooling channel At least a portion of the cooling fluid contacts the trip strip In particular, at least a portion of the cooling fluid contacts the first section of the upstream surface, where the cooling fluid is directed upwardly at an angle that is nonparallel and nonorthogonal to the inner surface forming the cooling channel. The cooling fluid then strikes the second section of the upstream surface, which causes the cooling fluid to be directed at an even steeper angle away from the inner surface. The cooling fluid then flows past the second section and along the top surface. While passing the first section, the second section and the top surface, heat is being passed from the trip strip to the cooling fluid via convection The cooling fluid flows past the top surface and then a portion of the cooling fluids forms a circular flow of cooling fluids that flow against the concave downstream surface The formation of eddies on the downstream surface is mitigated by accommodating the primary vortex or eddie and ensuring higher velocity and thus higher heat transfer on the downstream surface as compared to the low velocity recirculation in conventional square or rectangle cross section trip strips. This uniquely shaped trip strip cross-sectional area creates higher internal convective cooling potential for the turbine blade cooling channel, thus generating a high rate of internal convective heat transfer and efficient overall cooling system performance. This performance equates to a reduction in cooling demand and better turbine engine performance. An advantage of the turbine airfoil cooling system is that the system is configured to cool cooling channels and because of its configuration is particularly well suited to cool cooling channels in industrial gas turbine engines.

Another advantage of the cooling system is that the configuration of the cross-sectional area of the trip strip reduces the amount of pressure drop typically associated with trip strips These and other embodiments are described in more detail below

BRIEF DESCRIPTION OF THE DRAWINGS

The accompanying drawings, which are incorporated in and form a part of the specification, illustrate embodiments of the presently disclosed invention and, together with the description, disclose the principles of the invention

DETAILED DESCRIPTION OF THE INVENTION

Figure 1:
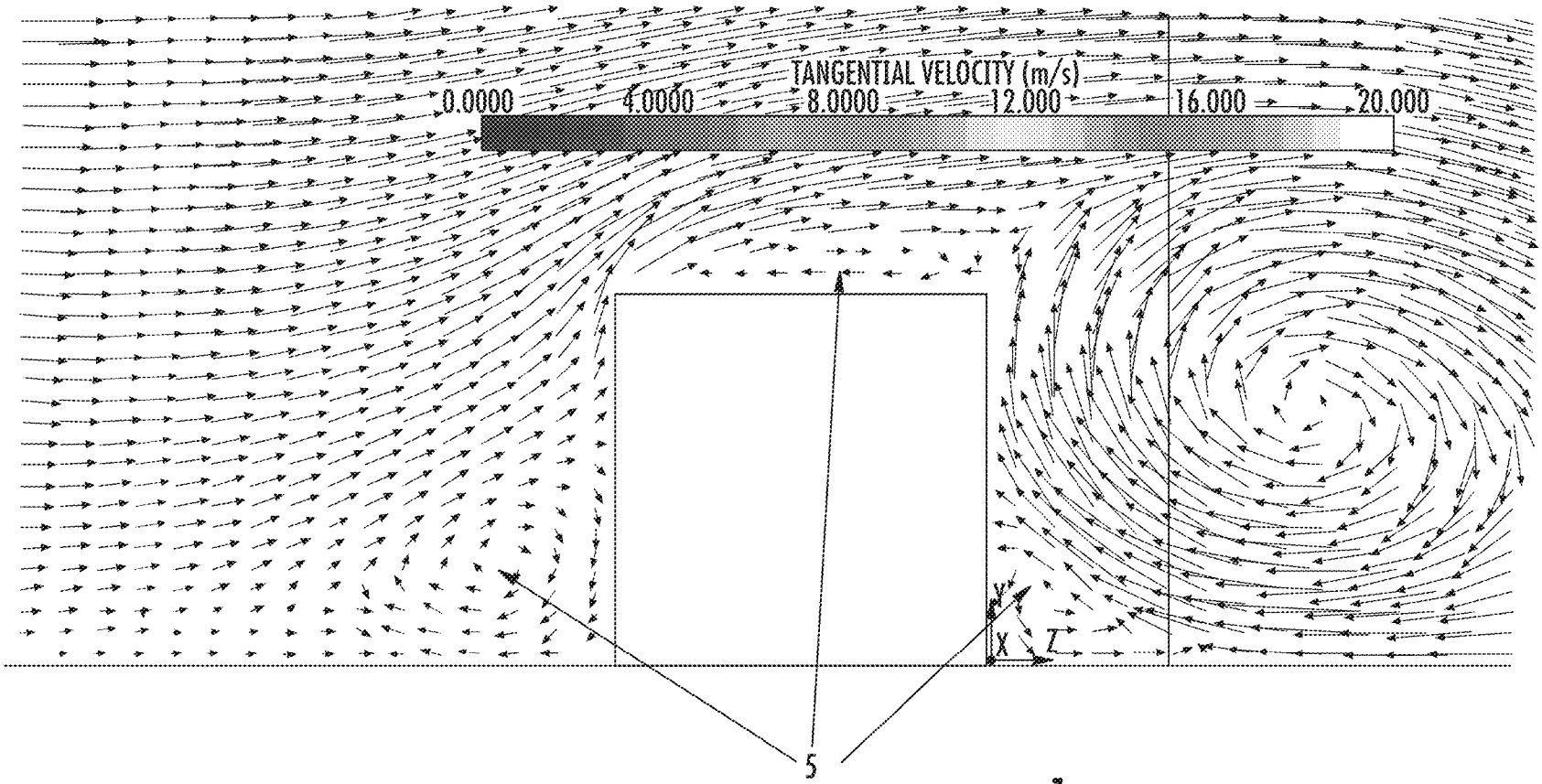
FIG. 1 PRIOR ART
FIG. 1 is cross-sectional view of a conventional trip strip positioned within a cooling channel in a turbine airfoil and shown with air flow vectors that show a detailed view of the cooling fluid flow in relation to the conventional trip strip
Figure 2:
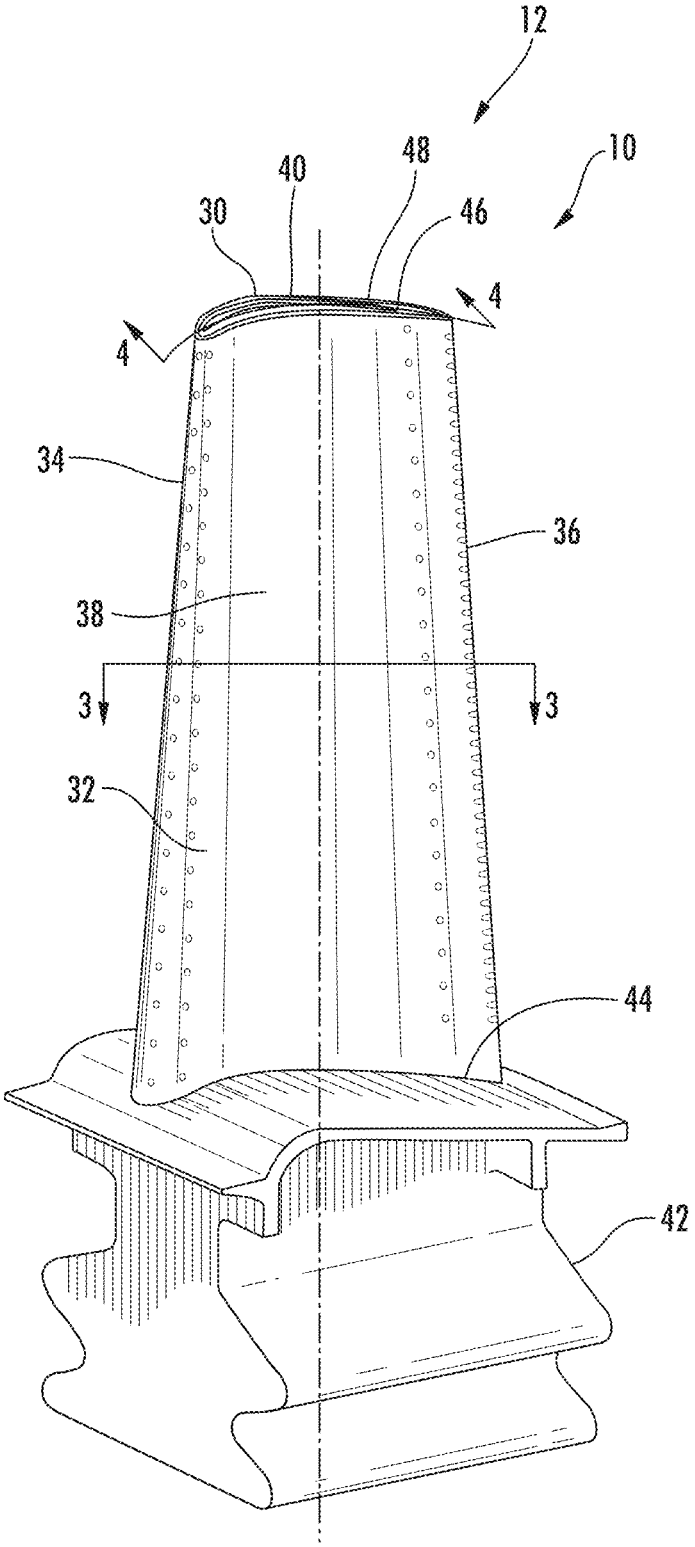
FIG. 2 is a perspective view of a turbine airfoil having features according to the instant invention.
Figure 3:
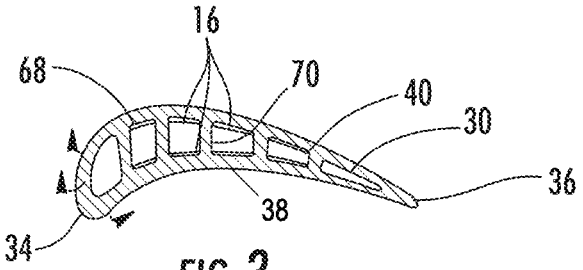
FIG. 3 is a cross-sectional view of the turbine airfoil shown in FIG. 2 taken along section line 3-3
Figure 4:
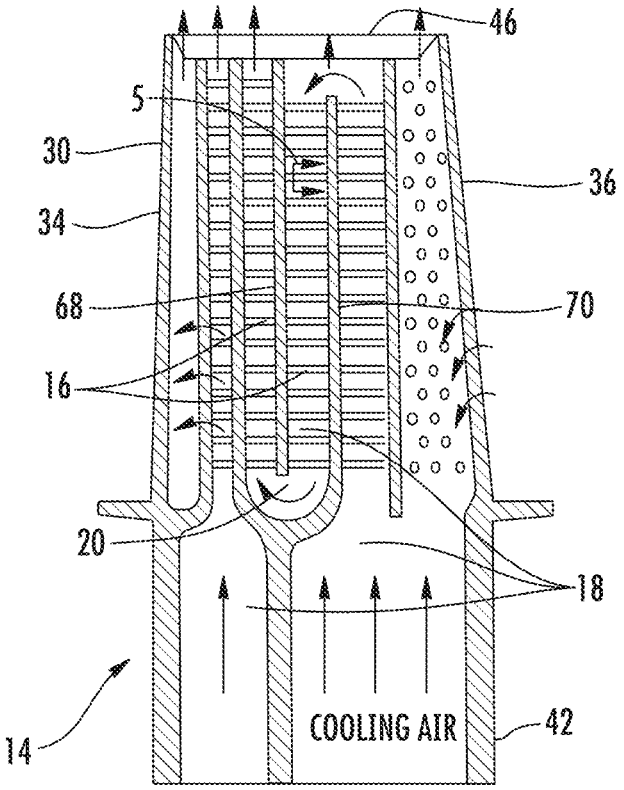
FIG. 4 is a cross-sectional, fillet view of the turbine airfoil shown in FIG. 2 taken along section line 4-4
Figure 5:
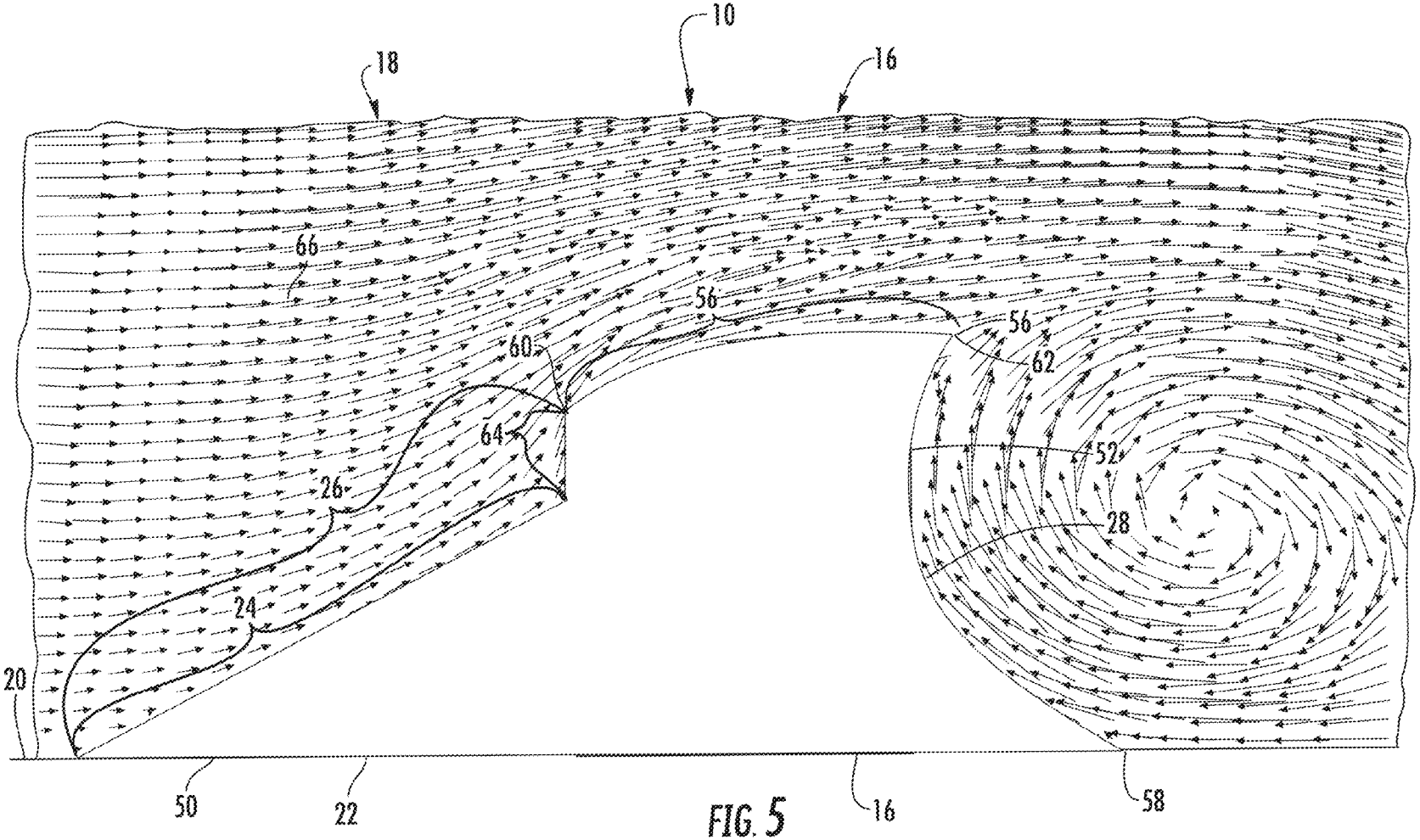
FIG. 5 is a cross-sectional view of a single trip strip of the cooling system of the invention taken along section line 5-5 in FIG. 4.

As shown in FIGS. 2-5, a turbine airfoil 10 usable in a turbine engine 12 and having at least one cooling system 14 with an efficient trip strip 16 is disclosed. At least a portion of the cooling system 14 may include one or more cooling channels 18 having one or more trip strips 16 protruding from an inner surface 20 forming the cooling channel 18, as shown in FIGS. 3 and 4. The trip strip 16 may have improved operating characteristics including enhanced heat transfer capabilities and a substantial reduction in pressure drop typically associated with conventional trip strips. In at least one embodiment, as shown in FIG. 5, the trip strip 16 may have a cross-sectional area 22 with a first section 24 of an upstream surface 26 of the trip strip 16 being positioned nonparallel and nonorthogonal to a surface 20 forming the cooling system channel 18 extending upstream from the trip strip 16 and a concave shaped downstream surface 28 of the trip strip 16 that enables separated flow to reattach to the cooling fluid flow In at least one embodiment, as shown in FIGS. 2 and 4, the turbine airfoil 10 may be formed from a generally elongated hollow airfoil 30 formed from an outer wall 32, and having a leading edge 34, a trailing edge 36, a pressure side 38, a suction side 40, a root 42 at a first end 44 of the airfoil 30 and a tip 46 at a second end 48 opposite to the first end 44, and a cooling system 14 positioned within interior aspects of the generally elongated hollow airfoil 30 The turbine airfoil 10 may include all of the these components or less than each of these components listed In addition, the turbine airfoil 10 may include fewer than each of these components.

The cooling system 14 may include one or more trip strips 16 protruding from an inner surface 20 defining a channel 18 of the cooling system 14 The trip strip 16 may be formed from a generally elongated body 50. The trip strip 16, as shown in FIG. 5, may have a cross-sectional area with at least a first section 24 of an upstream surface 26 of the trip strip 16 being positioned nonparallel and nonorthogonal to a surface 20 forming the cooling system channel 18 extending upstream from the trip strip 16 and a concave shaped downstream surface 28 of the trip strip 16. The downstream surface 28 of the trip strip 16 may be formed from a concave surface forming generally a quarter circle. In other embodiments, the downstream surface 28 is not limited to being a quarter circle but may be formed from other sized partial circles as well, such as, but not limited to, between 1/16 of a circle and ½ of a circle. An upstreammost point 52 of the downstream surface 28 of the trip strip 16 may be positioned upstream from an intersection 54 of the downstream surface 28 at a top surface 56 of the trip strip 16 The upstreammost point 52 of the downstream surface 28 of the trip strip 16 may be positioned upstream from the intersection 58 of the downstream surface 28 and the inner surface 20 defining the channel 18 of the cooling system 14, In at least one embodiment, the trip strip 16 may include a nonlinear top surface 56. The nonlinear top surface 56 may have a convex shaped outer surface The nonlinear top surface 56 may have a leading edge 60 that is positioned closer to the inner surface 20 defining the channel 18 of the cooling system 14 than a trailing edge 62 of the nonlinear top surface 56.

The upstream surface 26 of the trip strip 16 may include a second section 64 that is nonparallel and nonothogonal with the first section 24. The second section 64 of the upstream surface 26 may be positioned generally orthogonal to the surface 20 forming the cooling system channel 18 extending upstream from the trip strip 16 The second section 64 of the upstream surface 26 may be positioned generally orthogonal to a longitudinal axis 66 of the channel 18 of the cooling system 14 in which the trip strip 16 resides.

In at least one embodiment, the trip strip 16 may have a consistent cross-sectional area throughout an entire length of the trip strip 16. In another embodiment, the shape of the cross-sectional area of the trip strip 16 may vary throughout its length, especially when the trip strip 16 is nonorthogonal to the flow of cooling fluids over the trip strip 16, such as when the trip strip 16 is nonorthogonal to a longitudinal axis of the cooling channel 18 The trip strip 16 may extend from a first sidewall 68 to a second sidewall 70 forming the cooling channel 18. In another embodiment, the trip strip 16 may extend between the first and second sidewalls 68, 70 but only contact one of the sidewalls 68, 70 or stop short of contacting either sidewalls 68, 70. In yet another embodiment, the trip strip 16 may be positioned generally orthogonal to the longitudinal axis 66 of the cooling channel 18 The trip strip 16 may also be positioned nonparallel and nonorthogonal to the longitudinal axis 66 of the cooling channel 18 The height, e, of the trip strip 16 can change as a function of the relative distance between upstream and downstream trip strips 16, the pitch p. A consistent p/e ratio may be maintained for a cooling channel 18 or the p/e ratio may be varied along a portion of or along an entire length of the cooling channel 18.

During use, cooling fluid is passed into the cooling system 14, including the cooling channel 18. At least a portion of the cooling fluid contacts the trip strip 16. In particular, at least a portion of the cooling fluid contacts the first section 24 of the upstream surface 26, where the cooling fluid is directed upwardly at an angle that is nonparallel and nonorthogonal to the inner surface 26 forming the cooling channel 18. The cooling fluid then strikes the second section 64 of the upstream surface 26, which causes the cooling fluid to be directed at an even steeper angle away from the inner surface 26 The cooling fluid then flows past the second section 64 and along the top surface 56. While passing the first section 24, the second section 64 and the top surface 56, heat is being passed from the trip strip 16 to the cooling fluid via convection. The cooling fluid flows past the top surface 56 and then a portion of the cooling fluids forms a circular flow of cooling fluids that flow against the concave downstream surface 28 The flow of cooling fluids flows against the concave downstream surface 28 without formation of any eddies which would reduce the heat transfer and therefore negatively affect the heat transfer efficiency of the trip strip 16.

This uniquely shaped trip strip cross-sectional area creates higher internal convective cooling potential for the turbine blade cooling channel 18, thus generating a high rate of internal convective heat transfer and efficient overall cooling system performance. This performance equates to a reduction in cooling demand and better turbine engine performance.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil;

at least one trip strip protruding from an inner surface defining a channel of the cooling system, wherein the at least one trip strip is formed from a generally elongated body and wherein the at least one trip strip has a cross-sectional area with at least a first section of an upstream surface of the at least one trip strip being positioned nonparallel and nonorthogonal to the inner surface forming the cooling system channel extending upstream from the at least one trip strip and a concave shaped downstream surface of the at least one trip strip, wherein the downstream surface is concave shaped from a first intersection of the downstream surface and a top surface of the at least one trip strip and a second intersection of the downstream surface and the inner surface defining the channel of the cooling system, wherein an upstreammost point of the downstream surface is positioned upstream from the first and second intersections.

2. The turbine airfoil of claim 1, wherein the downstream surface of the at least one trip strip is formed from a concave surface forming generally a quarter circle.

3. The turbine airfoil of claim 1, wherein the at least one trip strip includes nonlinear top surface.

4. The turbine airfoil of claim 3, wherein the nonlinear top surface has a convex shaped outer surface.

5. The turbine airfoil of claim 4, wherein the nonlinear top surface has a leading edge that is positioned closer to the inner surface defining the channel of the cooling system than a trailing edge of the nonlinear top surface.

6. The turbine airfoil of claim 1, wherein the upstream surface of the at least one trip strip includes a second section that is nonparallel and nonorthogonal with the first section.

7. The turbine airfoil of claim 6, wherein the second section of the upstream surface is positioned generally orthogonal to the surface forming the cooling system channel extending upstream from the at least one trip strip.

8. The turbine airfoil of claim 6, wherein the second section of the upstream surface is positioned generally orthogonal to a longitudinal axis of the channel of the cooling system in which the at least one trip strip resides.

9. The turbine airfoil of claim 1, wherein the at least one trip strip has a consistent cross-sectional area throughout an entire length of the at least one trip strip.

* * * * *